United States Patent [19]

Taira

[11] Patent Number: 4,501,245

[45] Date of Patent: Feb. 26, 1985

[54] FUEL INJECTION VALVE WITH VARIABLE LIFTING AMOUNT OF THE NOZZLE NEEDLE

[75] Inventor: Shigeo Taira, Higashimatsuyama, Japan

[73] Assignee: Diesel Kiki Co., Ltd., Tokyo, Japan

[21] Appl. No.: 591,425

[22] Filed: Mar. 20, 1984

[30] Foreign Application Priority Data

Mar. 25, 1983 [JP] Japan ..... 58-42788[U]

[51] Int. Cl.[3] ..... F02M 39/00

[52] U.S. Cl. ..... 123/446; 123/504; 239/533.3

[58] Field of Search ..... 123/446, 504, 501, 502, 123/503; 239/533.3, 533.4, 533.7, 533.9

[56] References Cited

U.S. PATENT DOCUMENTS

| | | | |
|---|---|---|---|
| 3,425,635 | 2/1969 | Guertler | 239/533.3 |
| 3,430,866 | 3/1969 | Guertler | 239/533.3 |
| 3,820,723 | 6/1974 | Shipinski | 239/533.3 |
| 4,249,499 | 2/1981 | Perr | 123/504 |
| 4,285,471 | 8/1981 | Eklen et al. | 239/533.4 |

FOREIGN PATENT DOCUMENTS

| | | | |
|---|---|---|---|
| 1032543 | 7/1953 | France | 239/533.3 |
| 2092223 | 8/1982 | United Kingdom | 123/446 |

*Primary Examiner*—Magdalen Y. C. Moy

*Attorney, Agent, or Firm*—Frishauf, Holtz, Goodman & Woodward

[57] ABSTRACT

A piston is rotatably received within a piston chamber formed in the nozzle holder for lifting together with the nozzle needle. An oil passage opens in the piston chamber in a manner closable by the lifting piston. After the closure of the oil passage, the lifting piston cooperates with the piston chamber to define a confined space whereby further lifting of the piston is prohibited. The piston remote from the nozzle needle has an end face thereof so configurated that the piston lifts through a stroke variable as the piston varies in circumferential position, from the time the nozzle needle starts lifting to the time the piston closes the oil passage. Preferably, the circumferential position of the piston is controlled by rotating means which rotates the piston in response to at least one parameter indicative of the operation of the engine.

10 Claims, 6 Drawing Figures

FUEL INJECTION VALVE WITH VARIABLE LIFTING AMOUNT OF THE NOZZLE NEEDLE

BACKGROUND OF THE INVENTION

This invention relates to a fuel injection valve for use in an internal combustion engine, which is adapted to vary the lift or lifting amount of the nozzle needle and accordingly the injection rate in response to operating parameters of the engine such as the rotational speed.

A conventional fuel injection valve for diesel engines or the like includes a nozzle needle and a nozzle spring for biasing the nozzle needle in the valve closing direction. The nozzle needle is lifted against the force of the nozzle spring by the pressure of pressurized fuel supplied from a fuel injection pump driven by the engine at speeds as a function of the rotational speed of the engine, to allow the fuel to be injected through the nozzle hole. The pressure of fuel pumped by the fuel injection pump increases at a rate substantially proportional to an increase in the rotational speed of the engine so that the lifting amount of the nozzle needle increases accordingly or at a rate substantially proportional to the increase of the engine speed, resulting in a corresponding increase in the injection rate. However, to achieve good operating characteristics of the engine, it is desirable that the injection rate of such a fuel injection valve should be controlled in response to operating conditions of the engine. Particularly in a low speed region of the engine, the injection rate should be reduced so as to make the operation of the engine stable in such low engine speed region, prevent idling noise of the engine, reduce the amount of hydrocarbons at low load operation of the engine, etc.

In attempt to comply with the above requirements, a fuel injection valve has been proposed by the assignee of the present application in Japanese Provisional Utility Model Publication No. 57-167257, which is capable of controlling the lifting amount of the nozzle needle in response to the rotational speed of the engine. According to this proposed fuel injection valve, a piston means is provided in a separate body from the main body of the fuel injection valve, which is displaceable in response to the rotational speed of the engine. A rod is connected to the piston means by means of a link mechanism and disposed in urging contact with a nozzle spring for axial displacement in the main body. Displacement of the piston means responsive to the rotational speed of the engine causes axial displacement of the rod through the link mechanism to thereby vary the set length of the nozzle spring and accordingly the lifting amount of the nozzle needle.

However, the proposed fuel injection valve inevitably has a complicated structure wherein the piston means is arranged outside the main body is connected to the latter through the link mechanism for controlling the valve. Further, the piston means is responsive to the rotational speed of the engine alone, but the provisional publication lacks any teaching of utilizing other operating parameters of the engine to control the valve.

SUMMARY OF THE INVENTION

It is the object of the invention to provide a fuel injection valve for use in an internal combustion engine, which is simple in structure but permits setting the lifting characteristic of the nozzle needle and accordingly the injection rate characteristic of the valve in various manners in response to operating parameters of the engine.

A fuel injection valve for use in an internal combustion engine according to the invention includes a nozzle body, a nozzle holder supporting the nozzle body, a nozzle needle disposed in the nozzle body, and a nozzle spring disposed in the nozzle holder and urging the nozzle needle toward its seated position.

A piston chamber is formed in the nozzle holder, of which an end portion remote from the nozzle needle is closed. Received within the piston chamber is a piston which is liftable together with the nozzle needle and rotatable about its own axis. A fluid passage opens in the piston chamber for supplying and discharging pressurized fluid to and from the same chamber. The fluid passage is disposed to be closed by the piston when the latter is lifted. After thus closing the fluid passage during lifting, the piston defines a closed space in the piston chamber in cooperation therewith, whereby lifting of the piston is interrupted. Further provided are a return spring urging the piston toward the nozzle needle, and rotating means for rotating the piston about its own axis. The piston remote from the nozzle needle has an end face thereof so configurated that the piston lifts through a stroke variable as the piston varies in circumferential position, from the time the nozzle needle starts lifting to the time the piston closes the fluid passage.

Preferably, the piston-rotating means is operable in response to at least the rotational speed of the engine.

The above and other objects, features, and advantages of the invention will be more apparent from the ensuing detailed description taken in conjunction with the accompanying drawings.

DETAILED DESCRIPTION

The invention will now be described in detail with reference to the drawings illustrating an embodiment thereof.

Figure 1:
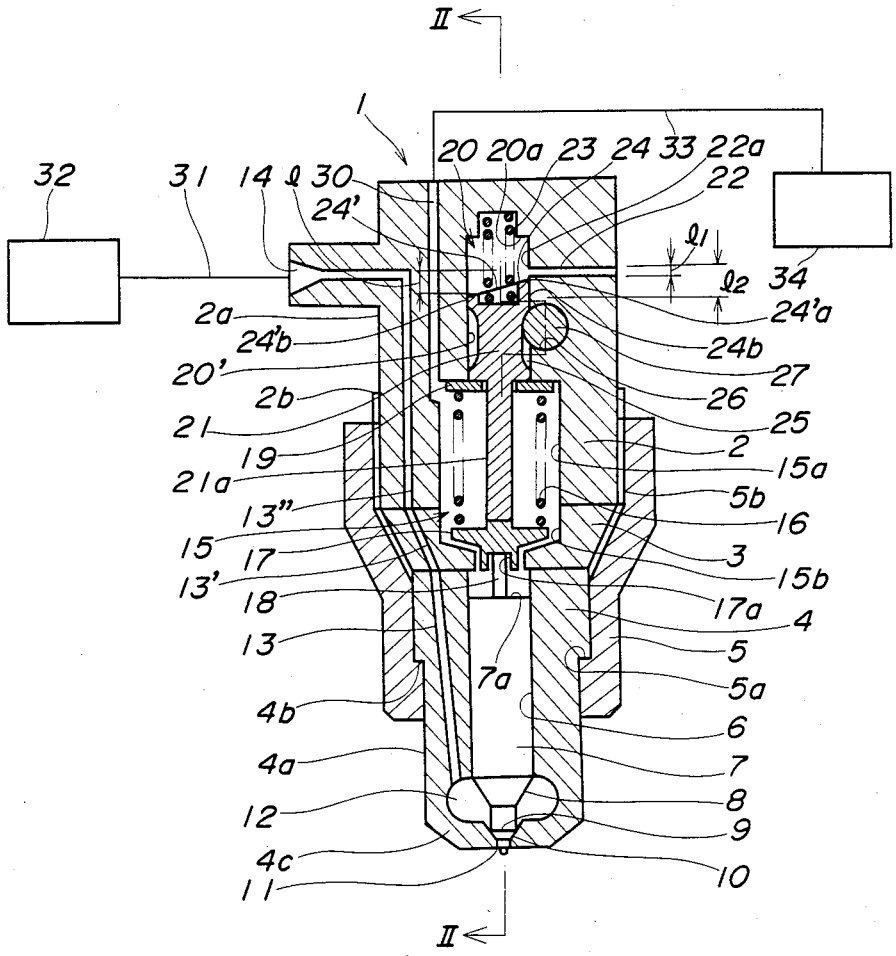
FIG. 1 is a longitudinal sectional view of a fuel injection valve according to an embodiment of the invention.

Referring first to FIG. 1, reference numeral 1 designates a fuel injection valve according to the invention which is mounted in an internal combustion engine, not shown. A nozzle holder 2, a distance piece 3, and a nozzle body 4 are axially aligned with each other and combined together by a retaining member 5 threadedly fitted over the nozzle holder 2 and the distance piece 3.

A nozzle needle 7 is slidably fitted through a central bore 6 formed in the nozzle body 4 along its axis. A lower end portion of the nozzle needle 7 is gradually reduced in diameter toward its tip to provide a pressure-applying portion 8 and a conical seating portion 9, each in the form of a truncated cone. The seating portion 9 is disposed for seating on a valve seat 10 having a concave conical surface and formed in an end wall 4*c* of the nozzle body 4 remote from the nozzle holder 2. A nozzle hole 11 is formed in the nozzle body 4 in a manner continued from the valve seat 10 and opens in an outer end face of the end wall 4*c*. The nozzle body 4 is also formed therein with a pressure chamber 12 in which is disposed the pressure-applying portion 8 of the nozzle needle 7. The pressure chamber 12 communicates with a fuel inlet port 14 formed in a lateral side wall of the nozzle holder 2 by way of fuel passages 13, 13' and 13'' formed through the nozzle body 4, the distance piece 3 and the nozzle holder 2, respectively, and aligned with each other. Cavities 15*a* and 15*b* are formed in the nozzle holder 2 and the distance piece 3, respectively, to cooperatively define a spring chamber 15 in which are disposed a nozzle spring 16, a spring seat 17 supporting a lower end of the nozzle spring 16, and a shim 19 disposed on an inner end face of the spring chamber 15 and on which the nozzle spring 16 is seated. The spring seat 17 has its lower end face formed with a hole 17*a* receiving an upper end of a coupling rod 18 integral with the nozzle needle 7.

Thus, the nozzle needle 7 is biased toward the end wall 4*c* of the nozzle body 4 by the force of the nozzle spring 16, with its conical seating portion 9 seated on the valve seat 10 of the nozzle body 4 to thereby bias the valve in its closed position. The shim 19 does not only serve as an upper spring seat for the nozzle spring 16 but also serves to adjust the setting load of the nozzle spring 16 and accordingly the valve opening pressure of the nozzle needle 7 by having its thickness selected at a suitable value.

A piston chamber 20 is formed in the nozzle holder 2 along its axis and disposed supra-adjacent the spring chamber 15, in which is slidably received a piston 21. An end face 24 of the piston 21 remote from the nozzle needle 7 is adapted to define a closed space 20*a* in cooperation with inner surfaces 20' of the piston chamber 20. Also formed in the nozzle holder 2 is an oil passage 22 which opens at its radially inner end 22*a* in the inner peripheral surface 20' of the piston chamber 20 at a predetermined location. A return spring 23 is interposed between an end face of the piston 21 remote from the nozzle needle 7 and an opposed inner end face of the piston chamber 20 and urges the piston 21 toward the nozzle needle 7 so as to maintain a lower end face of the piston 21 in urging contact with the shim 19 when the nozzle needle 7 is in its seated position. The piston 21 is formed integrally with a rod 21*a* axially extending in the spring chamber 15 toward the nozzle needle 7, with its lower end face disposed in urging contact with an upper surface of the lower spring seat 17 so that the piston 21 is axially displaceable together with the nozzle needle 7.

Figure 5:
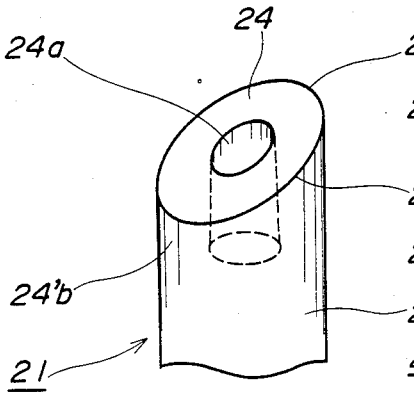
FIG. 5 is a fragmentary perspective view of an end portion of the piston in FIG. 1.

The piston 21 has a generally cylindrical body with an obliquely cut head portion, that is, the end face 24 of the piston 21 remote from the nozzle needle 7 presents an obliquely cut surface. By so configurating the head portion, the axial distance l between the peripheral edge 24' of the sloped end face 24 of the piston 21 and the upper edge of the open end 22*a* of the oil passage 22 is variable as the circumferential position of the piston 21 varies. More specifically, in the illustrated embodiment, assuming that the nozzle needle 7 is in its seated position, when the piston 21 assumes such a circumferential position that a first predetermined circumferential portion 24'*a* of the peripheral edge 24' of the end face 24 shown in FIG. 5 is axially aligned with the open end 22*a* of the oil passage 22, the above distance l assumes a minimum value l1, while when the piston is so circumferentially positioned that a second predetermined circumferential portion 24'*b* of the same peripheral edge 24' is axially aligned with the open end 22*a*, the distance l assumes a maximum value l2. That is, the minimum distance l1 and the maximum distance l2 determine a minimum lifting amount and a maximum lifting amount of the nozzle needle 7, respectively. Therefore, by rotating the piston 21 or varying the circumferential position of same, the lifting amount or stroke of the nozzle needle 7 can be varied between miminum and maximum values l1 and l2.

Figure 2:
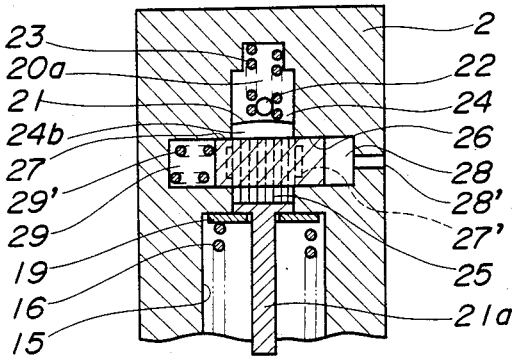
FIG. 2 is a fragmentary longitudinal sectional view taken along line II—II in FIG. 1 and showing piston-rotating means appearing in FIG. 1 and its peripheral parts.

FIG. 2 illustrates a mechanism for rotating the piston 21 to vary the lifting amount of the nozzle needle 7. The piston 21 has its outer peripheral surface 24*b* formed with a pinion gear 25 circumferentially extending along at least half of the whole periphery of the piston 21. A rack hole 26 is formed in the nozzle holder 22 and extends tangentially to the axis of the pinion gear 25. The rack hole 26 has a lateral side wall thereof cut out and opening in the piston chamber 20. A cylindrical rack 27 is slidably fitted in the rack hole 26 and formed with a rack gear 27' meshing with the pinion gear 25 through the open lateral side wall of the rack hole 26. Opposite end faces of the rack 27 cooperate with inner surfaces of the rack hole 26 to define a spring chamber 29 and a control chamber 28. A spring 29' is disposed in the spring chamber 29, while the control chamber 28 is disposed to be supplied through an oil passage 28' with pressurized operating oil, the pressure of which varies as a function of the rotational speed of the engine, as hereinafter described.

The rack 27 has its opposite end faces acted upon by input oil pressure introduced into the control chamber 28 through the oil passage 28' and the force of the spring 29' so that it assumes a position where the acting spring force and the acting oil pressure are in an equilibrium. Axial movement of the rack 27 in the rack hole 26 causes rotation of the piston 21 through the pinion gear 25 to vary the lifting amount or stroke of the nozzle needle 7.

The fuel injection valve 1 is mounted in the engine with its nozzle hole 11 opening in a cylinder of the engine. The fuel inlet port 14 is connected to a fuel injection pump 32 by means of an injection pipe 31. An overflow fuel passage 30 is formed in the nozzle holder 2 in communication with the spring chamber 15 and is connected to a fuel tank 34 by means of an overflow pipe 33. The piston chamber 20 is filled with oil under constant pressure supplied from a pressurized oil source, not shown, through the oil passage 22.

The fuel injection valve according to the invention constructed as above operates as follows: Fuel oil pumped from the fuel injection pump 32 flows into the fuel passage 13'' through the injection pipe 31 and the fuel inlet port 14 and then flows through the further oil passages 13', 13 into the pressure chamber 12 in the nozzle body 14. When the pressure of fuel oil supplied into the pressure chamber 12 exceeds a predetermined valve opening pressure, the nozzle needle 7 forcedly starts lifting against the force of the nozzle spring 16. At the same time, the piston 21 also starts lifting together with the nozzle needle 7 with its rod 21*a* upwardly pushed by the nozzle needle 7 through the spring seat 17. As the piston 21 thus lifts, the oil filled in the piston chamber 20 is discharged through the oil passage 22. When the piston 21 further lifts, the inner open end 22*a* of the oil passage 22 is closed by the outer peripheral surface 24*b* of the piston 21. Then, the closed space 20*a* is defined in the piston chamber 20, in which oil is confined to interrupt further lifting of the nozzle needle 7. If the piston 21 is then so circumferentially positioned that the aforementioned first predetermined circumferential portion 24'*a* of the peripheral edge 24' of the end face 24 of the piston 21 is axially aligned with the inner open end 22*a* of the oil passage 22 for registering therewith as shown in FIG. 1, the aforementioned distance l assumes the minimum value l1, whereby the nozzle needle 7 is allowed to lift through the minimum stroke l1. On the other hand, if the piston 21 is in such a circumferential position that the second predetermined circumferential portion 24'*b* of the peripheral edge 24' of the end face 24 is axially aligned with the inner open end 22*a* of the oil passage 22 for registering therewith, the distance l assumes the maximum value l2, and accordingly the nozzle needle 7 is allowed to lift through the maximum stroke l2. If the piston 21 assumes an intermediate circumferential position other than the above two extreme circumferential positions, the nozzle needle 7 is allowed to lift through a medium stroke.

The rotation of the piston 21 for control of the lifting amount of the nozzle needle 7 may be carried out by manually operating the rack 27 meshing with the pinion gear 25 on the outer peripheral surface of the piston 21. However, in the illustrated embodiment, the oil passage 28' communicating with the control chamber 28 is connected to a suction chamber, not shown, of the fuel injection pump, in which fuel pressure variable in substantial proportion to the rotational speed of the engine prevails, so that the rack 27 is displaced in response to such oil pressure toward a position in which the oil pressure and the force of the spring 29' are balanced with each other, to rotate the piston 21, thereby varying the lifting amount of the nozzle needle 7 as a function of the rotational speed of the engine.

Figure 3:
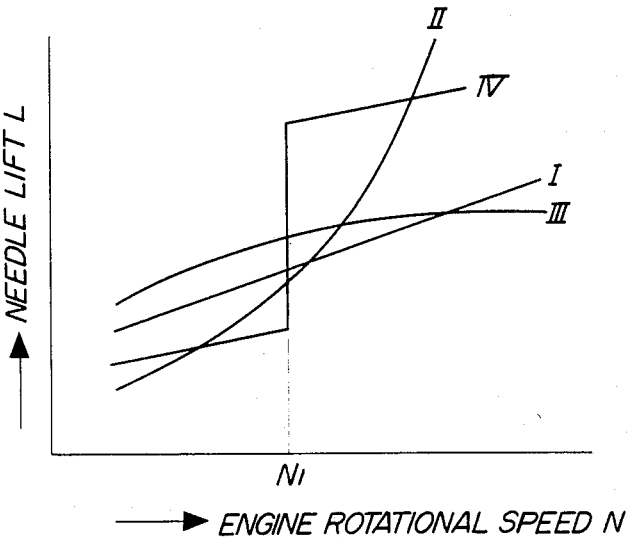
FIG. 3 is a graph showing examples of the engine rotational speed-nozzle needle lifting characteristic which are settable with a fuel injection valve according to the invention, as well as a comparative example of same settable with a conventional fuel injection valve.

FIG. 3 shows the relationship between the rotational speed N of the engine and the lifting amount L of the nozzle needle for comparison between the lifting characteristic of a conventional fuel injection valve in which no control is made of the lifting motion of the nozzle needle and that of the fuel injection valve according to the present embodiment of the invention in which the lifting motion of the nozzle needle is controlled as described above. According to the conventional fuel injection valve, as indicated by the line I, the lifting amount L increases at a rate directly proportional to an increase in the engine rotational speed N. On the other hand, according to the present embodiment of the invention, if the piston 21 is rotated such that the lifting amount L increases from a minimum value to a maximum value as the rotational speed N of the engine increases, a lifting characteristic can be obtained as indicated by the line II, in which the increasing rate of the lifting amount L is large with respect to an increase in the rotational speed N of the engine. On the other hand, if the piston 21 is rotated in the opposite direction to the above such that the lifting amount L decreases from a maximum value to a minimum value as the engine rotational speed N increases, a different lifting characteristic can be obtained as indicated by the line III, in which the increasing rate of the lifting amount L is small with respect to an increase in the engine rotational speed N in a low speed region, while the lifting amount L does not appreciably vary even with an increase in the engine rotational speed N in a high speed region.

Figure 4:
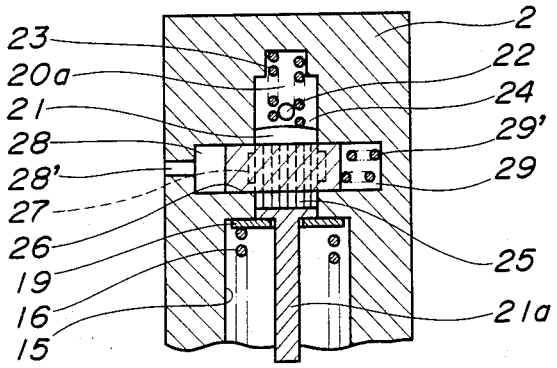
FIG. 4 is a view similar to FIG. 2, showing a variation of the piston-rotating means of FIG. 2.

To change the lifting characteristic of the nozzle needle between the line II and the line III as above, the piston 21 may be disposed in a diametrically opposite circumferential position to a former one, at a certain position of the rack 27, or as shown in FIGS. 1 and 4, the arrangement of the control chamber 28 and the spring chamber 29 may be reversed with respect to each other.

Figure 6:
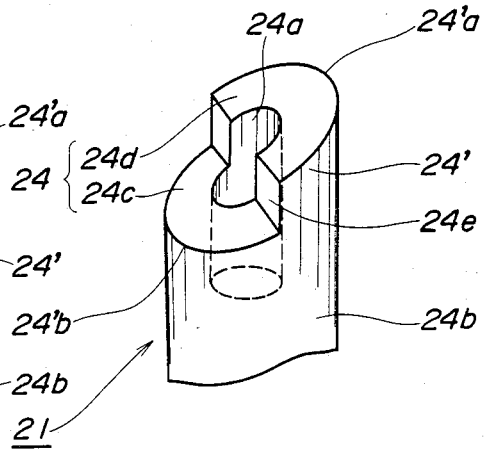
FIG. 6 is a view similar to FIG. 4, showing a variation of the same end portion of the piston.

If, as shown e.g. in FIG. 6, the end face 24 of the piston 21 is so configurated in a discontinuous surface that it comprises a first sloped surface 24*c* and a second sloped surface 24*d* which axially offset with a stepped portion 24*e* intervening therebetween, alternatively of the configuration shown in FIGS. 1 and 5 with a continuously sloped surface 24, a lifting characteristic as indicated by the line IV can be obtained according to which the lifting amount L suddenly increases as the engine rotational speed N rises above a predetermined value N1.

The operating fluid to be applied to the rack 27 may have its pressure varied not only as a function of the engine rotational speed but also as a function of other parameters indicative of the operation of the engine such as engine load. To realize this, the fuel pressure within the suction chamber of the fuel injection pump as a function of the engine rotational speed may be processed by an electronic control unit in response to at least one other operating parameter of the engine such as engine load, and the resulting control pressure is applied to the rack 27, or an output oil pressure from a suitable hydraulic apparatus may be processed by an electronic control unit in response to both the engine rotational speed and at least one other operating parameter of the engine, and the resulting control pressure is applied to the rack 27.

As set forth above, a wide variety of lifting characteristics of the nozzle needle optimal to operating conditions of the engine can be imparted to a fuel injection valve according to the invention.

While a preferred embodiment has been described, variations thereto will occur to those skilled in the art within the scope of the present inventive concepts which are delineated by the following claims.

What is claimed is:

1. A fuel injection valve for an internal combustion engine, comprising: a nozzle body; a nozzle holder supporting said nozzle body; a nozzle needle disposed in said nozzle body; a nozzle spring disposed in said nozzle holder and urging said nozzle needle toward a seated position thereof; a piston chamber formed within said nozzle holder and having a closed end portion remote from said nozzle needle; a piston received within said piston chamber, said piston being liftable together with said nozzle needle and rotatable about an axis thereof, said piston having an end face remote from said nozzle needle and an outer peripheral surface; a fluid passage opening in said piston chamber for supplying and discharging pressurized fluid to and from said piston chamber, said fluid passage being disposed to be closed by said piston when said piston is lifted, whereby after thus closing said fluid passage during lifting, said piston defines a closed space in said piston chamber in cooperation therewith, whereby lifting of said piston is interrupted; a return spring urging said piston toward said nozzle needle; and rotating means for rotating said piston about said axis thereof; said end face of said piston remote from said nozzle needle being so configurated that said piston lifts through a stroke variable as said piston varies in circumferential position, from the time said nozzle needle starts lifting to the time said piston closes said fluid passage.

2. A fuel injection valve as claimed in claim 1, wherein said end face of said piston comprises a sloped surface continuously extending obliquely with respect to said axis of said piston.

3. A fuel injection valve as claimed in claim 1, wherein said end face of said piston comprises a first sloped surface, and a second sloped surface, said first and second surfaces axially offsetting.

4. A fuel injection valve as claimed in claim 1, wherein said means for rotating said piston about said axis thereof is operable in response to at least one parameter indicative of the operating of said engine and at least including the rotational speed of said engine.

5. A fuel injection valve as claimed in claim 4, wherein said means for rotating said piston about said axis thereof comprises a rack hole formed in said nozzle holder, said rack hole having a lateral side wall thereof opening in said piston chamber, a rack slidably received within said rack hole, a rack gear formed on at least part of said outer peripheral surface of said piston and meshing with said rack; and control means responsive to fluid pressure as a function of said at least one parameter for causing displacement of said rack.

6. A fuel injection valve as claimed in claim 5, wherein said fluid pressure of said control means comprises fuel pressure substantially proportional to the rotational speed of said engine obtained from a fuel injection pump associated with said fuel injection valve.

7. A fuel injection valve as claimed in claim 4, wherein said means for rotating said piston about said axis thereof is adapted to rotate said piston in a direction in which said stroke of said piston increases as the rotational speed of said engine increases.

8. A fuel injection valve as claimed in claim 4, wherein said means for rotating said piston about said axis thereof is adapted to rotate said piston in a direction in which said stroke of said piston decreases as the rotational speed of said engine increases.

9. A fuel injection valve as claimed in claim 5, wherein said means for rotating said piston about said axis thereof is adapted to rotate said piston in a direction in which said stroke of said piston increases as the rotational speed of said engine increases.

10. A fuel injection valve as claimed in claim 5, wherein said means for rotating said piston about said axis thereof is adapted to rotate said piston in a direction in which said stroke of said piston decreases as the rotational speed of said engine increases.

* * * * *